US007992863B2

(12) United States Patent
Jacobs et al.

(10) Patent No.: US 7,992,863 B2
(45) Date of Patent: Aug. 9, 2011

(54) APPARATUS AND METHOD FOR TEMPORARILY INCREASING THE BEAM STRENGTH OF A MEDIA SHEET IN A PRINTER

(75) Inventors: Jos Jacobs, Sherwood, OR (US); Rob Huala, Tualatin, OR (US)

(73) Assignee: Xerox Corporation, Norwalk, CT (US)

( * ) Notice: Subject to any disclaimer, the term of this patent is extended or adjusted under 35 U.S.C. 154(b) by 56 days.

(21) Appl. No.: 12/416,547

(22) Filed: Apr. 1, 2009

(65) Prior Publication Data

US 2010/0252989 A1 Oct. 7, 2010

(51) Int. Cl.
*B65H 29/70* (2006.01)

(52) U.S. Cl. ..... 271/188; 271/209

(58) Field of Classification Search ..... 271/188, 271/209

See application file for complete search history.

(56) References Cited

U.S. PATENT DOCUMENTS

| | | | | |
|---|---|---|---|---|
| 5,280,901 | A | 1/1994 | Smith et al. | |
| 6,181,908 | B1 | 1/2001 | Leemhuis et al. | |
| 6,190,070 | B1 | 2/2001 | Urban et al. | |
| 6,499,737 | B2 * | 12/2002 | Slocum et al. | 271/188 |
| 7,029,004 | B2 * | 4/2006 | Asada et al. | 271/121 |

* cited by examiner

*Primary Examiner* — Michael C McCullough
(74) *Attorney, Agent, or Firm* — Maginot, Moore & Beck LLP

(57) ABSTRACT

A media sheet deformer provides an adjustable amount of media sheet deformation. The media sheet deformer nonpermanently deforms a media sheet in a printer to increase the beam strength of the media sheet temporarily. The device includes a deformer, a support member, and a positioning member. The deformer is positioned in a media path within a printer. The deformer is configured to deform a media sheet temporarily with an amount of media sheet deformation. The amount of media sheet deformation causes the media sheet to exhibit an arched profile that increases the beam strength of the media sheet. The support member is coupled to the deformer. The support member is movably coupled to a printer frame. The positioning member is coupled to the support member. The positioning member is configured to assert a force on the support member and alter the amount of media sheet deformation.

17 Claims, 6 Drawing Sheets

APPARATUS AND METHOD FOR TEMPORARILY INCREASING THE BEAM STRENGTH OF A MEDIA SHEET IN A PRINTER

TECHNICAL FIELD

The apparatus and method described below relate to printers having devices configured to increase the beam strength of media sheets transported within the printer system and, more particularly, to printers having devices that selectively and/or variably increase the beam strength of media sheets transported within the printer system.

BACKGROUND

In a typical printer, media trays store media sheets within the printer. During the printing cycle, a media transport system retrieves media sheets from an input tray, routes the media sheets along a media path to receive and fix an image on the media sheets, and transports the media sheets to an output tray or bin for collection by a user. Many users prefer a printer that applies an image to a media sheet quickly. Therefore, the media transport system may be configured to transport the media sheets along the media path at a relatively high speed.

The media transport system relies upon the rigidity of a media sheet when transporting a media sheet along the media path and through peripheral devices that may be coupled to the printer. In particular, a media sheet may be characterized as having a particular natural or inherent beam strength, which refers to the longitudinal rigidity of the media sheet. Beam strength is a desirable characteristic that allows a media sheet to travel along the media path quickly without becoming bent, curled, or otherwise damaged by the transport system.

Instead of requiring printers to use media sheets having a minimum natural or inherent beam strength, some printers utilize media sheet deforming devices, sometimes referred to as corrugation rollers or corrugators, to increase the beam strength of a media sheet temporarily. Media sheet deforming devices increase the beam strength of a media sheet by nonpermanently bending or deforming the sheet. In particular, media sheet deforming devices often deform a central portion of a media sheet so that the media sheet exhibits an arched longitudinal profile. The arched profile increases the beam strength of the media sheet to enable the media sheet to travel quickly along a media path and to extend farther from an output slot before bending or curling.

While known media sheet deforming devices work well, the amount of media sheet deformation may not be easily adjusted to accommodate a particular peripheral device attached to the printer. For instance, peripheral devices such as staplers, stackers, and hole punches, may each operate with greater efficiency when functioning with a media sheet exhibiting a specific amount of deformation. Furthermore, known media sheet deforming devices do not permit a user to eliminate the amount of media sheet deformation when utilizing a particular type of media sheet or a particular peripheral device that does not require or benefit from increased media sheet beam strength. Thus, while known media sheet deforming devices deliver satisfactory results in most applications, known media sheet deforming devices may deliver optimally deformed media sheets for only a particular type of media sheet or peripheral device.

SUMMARY

A media sheet deforming device provides an adjustable amount of media sheet deformation. The media sheet deforming device nonpermanently deforms a media sheet in a printer to increase the beam strength of the media sheet temporarily. The device includes a deformer, a support member, and a positioning member. The deformer is positioned in a media path within a printer. The deformer is configured to deform a media sheet temporarily with an amount of media sheet deformation. The amount of media sheet deformation causes the media sheet to exhibit an arched profile that increases the beam strength of the media sheet. The support member is coupled to the deformer. The support member is movably coupled to a printer frame. The positioning member is coupled to the support member. The positioning member is configured to assert a force on the support member and alter the amount of media sheet deformation.

A printer for generating an image on a media sheet may include a media sheet deforming device that deforms a media sheet with an adjustable amount of media sheet deformation. The printer includes a first and second roller pair coupled to a printer frame. The first and second roller pairs are separated by a gap and are configured to transport media sheets along a media sheet transport plane. The printer also includes a media sheet deforming device. The device includes a deformer, a support member, and a positioning member. The deformer is movably positioned in the gap and is configured to intersect the media sheet transport plane and deform the media sheet temporarily with an amount of media sheet deformation. The amount of media sheet deformation causes the media sheet to exhibit an arched profile that increases the beam strength of the media sheet. The support member is coupled to the deformer and movably coupled to the printer frame. The positioning member is coupled to the support member and is configured to assert a force on the support member to alter an amount of media sheet deformation.

A method of nonpermanently deforming a media sheet in a printer to increase the beam strength of the media sheet temporarily includes positioning a deformer in a media path within a printer. The deformer is configured to deform a media sheet temporarily with an amount of media sheet deformation. The amount of media sheet deformation causes the media sheet to exhibit an arched profile that increases the beam strength of the media sheet. The method also includes coupling a support member to the deformer with the support member being movably coupled to a printer frame. The method further includes coupling a positioning member to the support member, and coupling a peripheral device to the printer frame with the peripheral device having an actuator configured to assert an actuator force on the positioning member. The actuator force is configured to alter an amount of media sheet deformation.

BRIEF DESCRIPTION OF THE FIGURES

The above described features and advantages, as well as others, will become more readily apparent to those of ordinary skill in the art by reference to the following detailed description and accompanying drawings. Features for adjusting the deformation of media sheets in a printer are discussed with reference to the figures.

DETAILED DESCRIPTION

Figure 1:
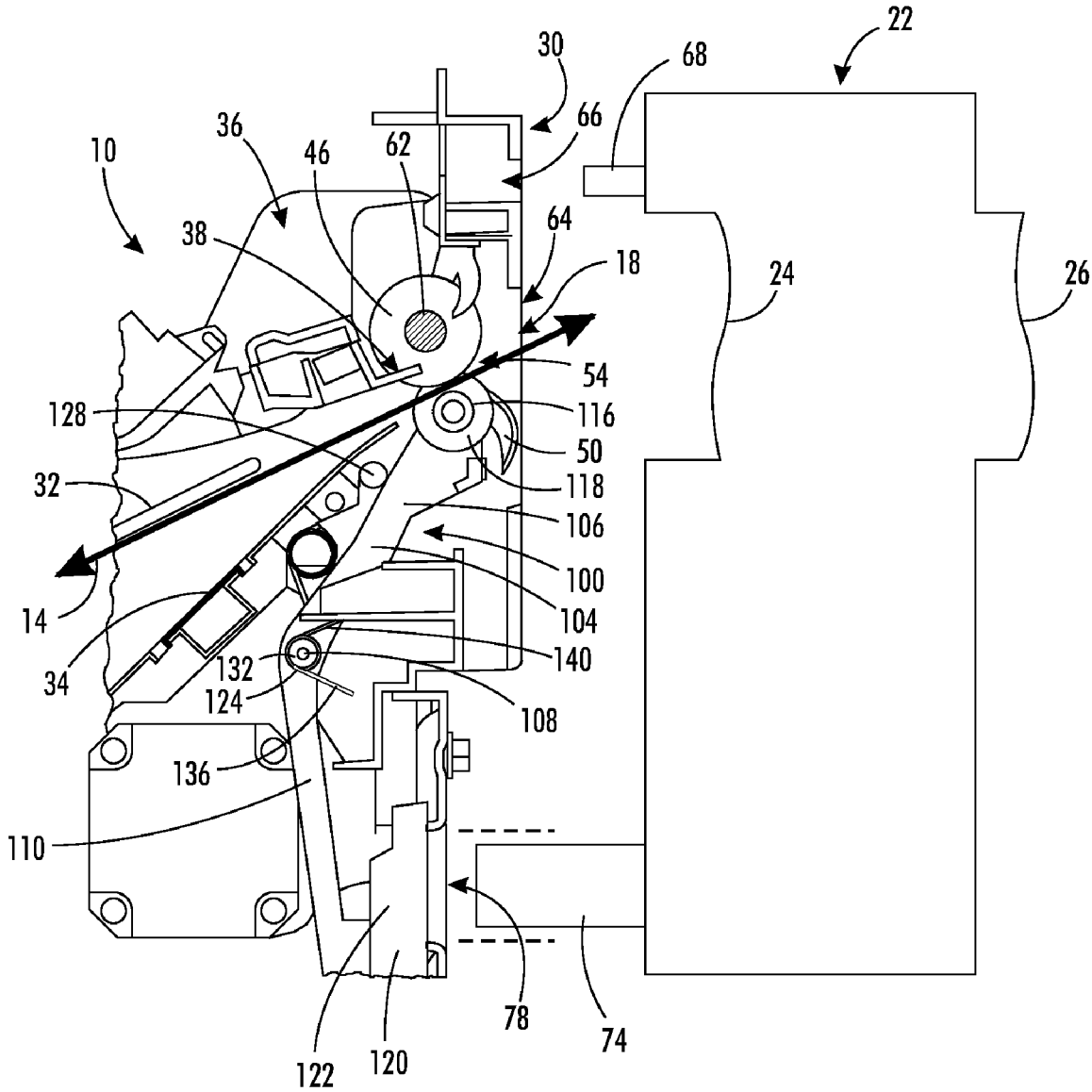
FIG. 1 illustrates a cross-sectional view of a media sheet deforming device, a printer, and a peripheral device that may be coupled to the printer.

The media sheet deforming device described herein temporarily deforms media sheets as they exit a printer. As used herein, the word "printer" refers, for example, to any apparatus, such as a digital copier, bookmaking machine, facsimile machine, multi-function machine, etc. that performs a print outputting function for any purpose. FIG. 1 shows a printer 10 having a media path 14 and a media discharge port 18. Typically, media sheets bearing an image are transported along the media path 14 to the media discharge port 18, where an output tray (not illustrated) collects the discharged media. To finish media sheets after discharging them, a peripheral device 22 may be coupled to a frame 36 of the printer 10. The peripheral device 22 may be a media sheet stacker, a hole puncher, or a stapler. Each type of peripheral device 22 treats or acts upon the media and discharges the media at an exit port 26 of the peripheral device 22. The peripheral device 22 is configured to couple to a connecting plate 30 of the printer 10.

Figure 2:
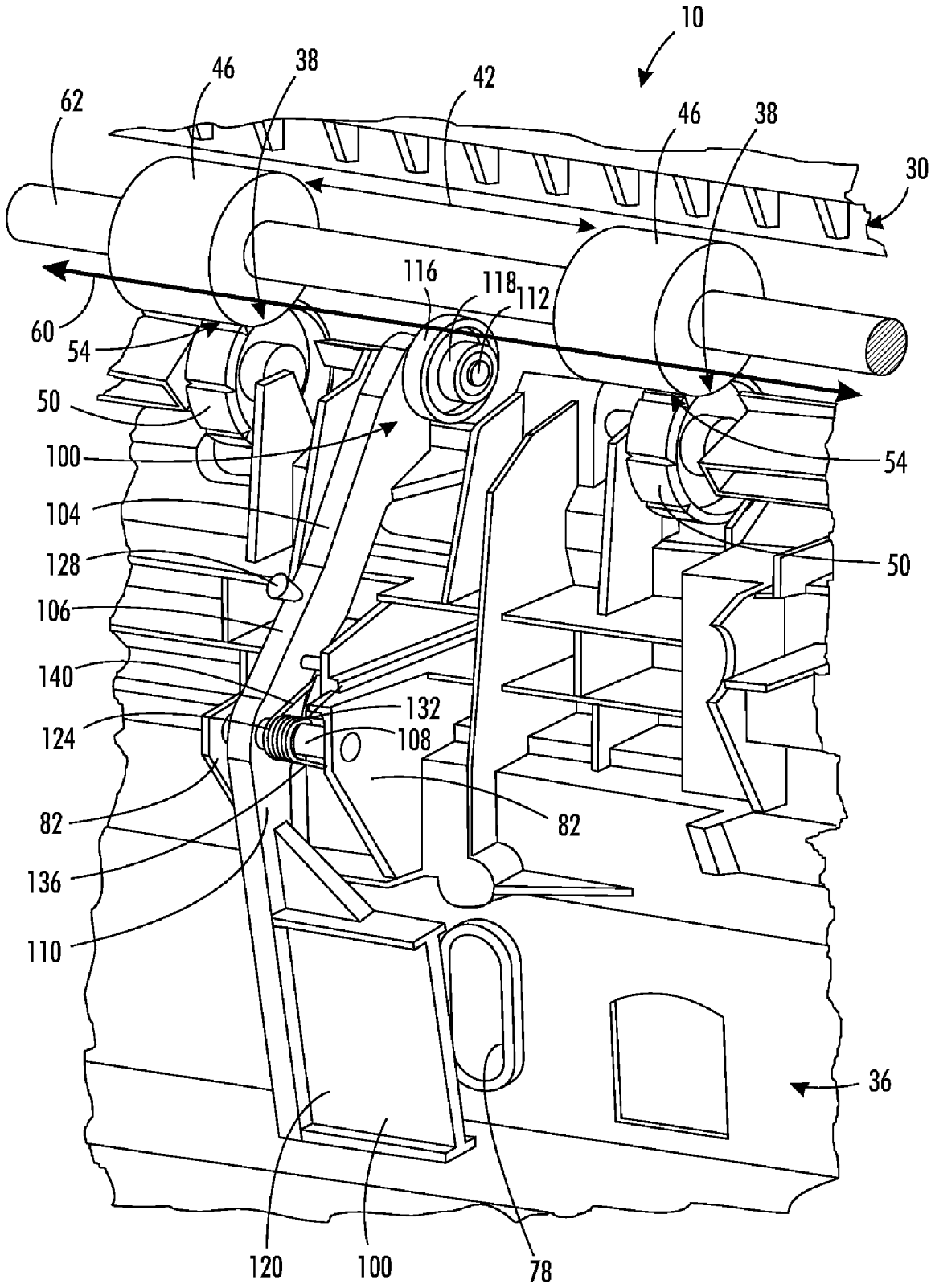
FIG. 2 illustrates a perspective view of the media sheet deforming device and the printer depicted in FIG. 1.
Figure 3:
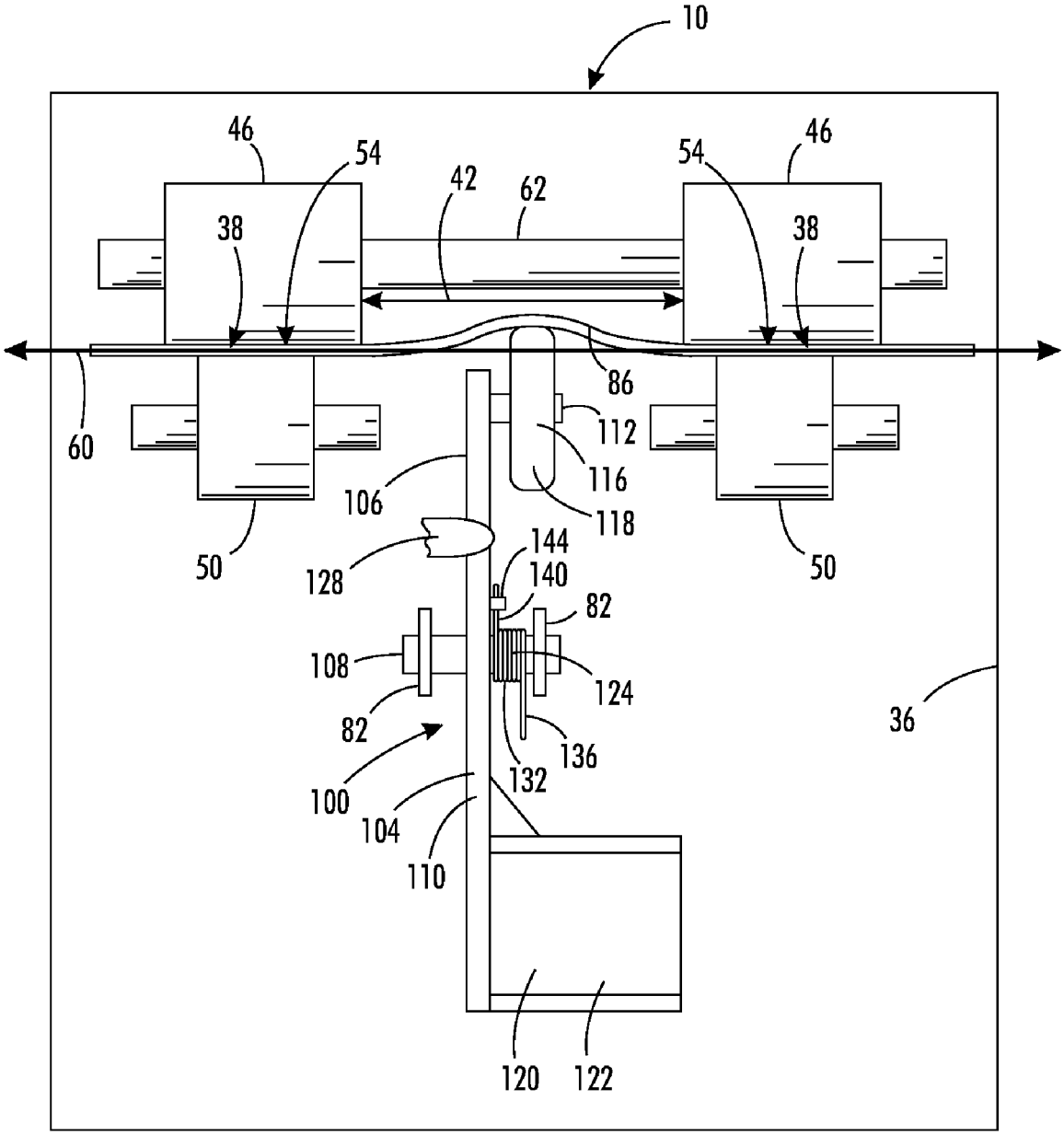
FIG. 3 illustrates an elevational view of the media sheet deforming device and the printer depicted in FIG. 1.

In more detail, the media path 14 includes guide surfaces 32, 34 and a plurality of roller pairs 38. The guide surfaces 32, 34 define the upper and lower boundaries of the media path 14. Near the end of the media path 14, the guide surfaces 32, 34 may draw near to each other in order to direct media sheets into the roller pairs 38. The roller pairs 38 transport the media sheets out of the printer 10 through the discharge port 18. As shown in FIGS. 2 and 3, the roller pairs 38 are separated by a gap 42. The gap 42 is the region in which the media sheet deforming device 100 contacts the media sheet transported by the roller pairs 38.

Each roller pair 38 includes a drive roller 46 and an idler roller 50. The drive rollers 46 and idler rollers 50 cooperate to receive media sheets being transported along the media path 14 and to propel the media sheets out of the discharge port 18 of the printer 10. In particular, the drive rollers 46 and idler rollers 50 contact each other to form a nip 54, as most clearly shown in FIG. 3. The term "nip" 54 refers to the junction of a drive roller 46 and an idler roller 50. When a media sheet contacts a nip 54 it becomes frictionally engaged by the roller pair 38 and is propelled along the media path 14. As shown by direction 60 of FIGS. 2 and 3, the nips 54 align to form a generally horizontal media sheet transport plane, referred to as a nip plane 60. The nip plane 60 represents the position of a media sheet transported by the roller pairs 38 when the media sheet has not been deformed by the media sheet deforming device 100.

The drive rollers 46 of the roller pairs 38 are coupled to a source of rotation. Specifically, the drive rollers 46 may be fixedly mounted upon a shaft 62 that is coupled to the rotational output of an electric motor (not illustrated). The rotational output of the electric motor causes the shaft 62 and the drive rollers 46 to rotate. The drive rollers 46 may be formed of materials capable of frictionally engaging both a media sheet and the idlers rollers 50, without marking or otherwise damaging the media sheet.

The idler rollers 50 are biased against the drive rollers 46 with a biasing member (not illustrated). The biasing action on the idler rollers 50 of the roller pairs 38 urges the media sheets in the nips 54 towards the drive rollers 46. Additionally, because the drive rollers 46 frictionally engage the idler rollers 50, the idler rollers 50 are driven by the drive rollers 46 when no media is present in the nips 54. The idler rollers 50 may become displaced from the drive rollers 46 in response to a media sheet entering the roller pairs 38 to compensate for different types of media sheets. Accordingly, media sheets of different thicknesses may be transported by the roller pairs 38 effectively. When the media sheet has exited the roller pairs 38, the biasing member causes the idler rollers 50 to contact the drive rollers 46 once again.

The connecting plate 30 includes features that assist in securing a peripheral device 22 to the printer 10. The connecting plate 30 may be coupled to the frame 36 of the printer 10 and may be configured to support the weight of a peripheral device 22 coupled thereto. Features of the connecting plate 30 include a media opening 64 and a receptacle 66. The media opening 64 is aligned with the media discharge port 18 of the printer 10. The media opening 64 guides media sheets into either a peripheral device 22 or a media output tray. The receptacle 66 engages a peripheral device 22 to couple the peripheral device 22 removably to the printer 10. The connecting plate 30 may have receptacles 66 in various locations to enable different types of peripheral devices 22 to be coupled to the printer 10.

The peripheral device 22 includes an entry port 24, an exit port 26, a fastening stud 68, and a pin or post provided as an actuator 74. To couple the peripheral device 22 to the printer 10, the fastening stud 68 may be engaged with the receptacle 66. When the peripheral device 22 is coupled to the printer 10 properly, the entry port 24 is aligned with the discharge port 18 of the printer 10. Accordingly, media sheets discharged by the printer 10 are received by the entry port 24 and may be treated by the peripheral device 22. After the peripheral device 22 treats the media sheets, the media sheets may be stored within the peripheral device 22 or the media sheets may be discharged from the peripheral device 22 through the exit port 26 into an output collection tray. Additionally, when the peripheral device 22 is coupled to the printer 10 the actuator 74 may be aligned with an opening 78 in the printer 10.

The actuator 74, as defined herein, is a pin, post, or other protuberance that projects outwardly from the peripheral device 22. Typically, the actuator 74 is used to assist in aligning the peripheral device 22 with the connecting plate 30 when coupling the peripheral device 22 to the printer 10. Accordingly, the actuator 74 may be made of rigid materials including, but not limited to, injection molded thermoplastics, carbon fiber materials, sheet metal, or other types of metals and metallic alloys. Besides assisting with the alignment of the peripheral device 22, the actuator 74 may also be configured to interface with the media sheet deforming device 100. To this end, the actuator 74 may have a predetermined length and width specifically designed to cause the media sheet deforming device 100 to deform a media sheet with a predetermined amount of deformation as required by the particular peripheral device 22 to which the actuator 74 is coupled.

The media sheet deforming device 100 of FIGS. 1-3 is positioned with reference to the media path 14 to enable the deformer 116 to temporarily deform a portion of a media sheet 86 (as shown in FIG. 3) as the sheet 86 is transported by the roller pairs 38. Media sheet deforming devices 100, sometimes referred to as media sheet corrugators, media sheet corrugation devices, or media sheet corrugating devices, increase the beam strength or corrugate media sheets 86 ejected from the discharge port 18 of the printer 10. The media sheet deforming device 100 includes a support member 104, a pivot shaft 108, a deformer 116, a positioning member 120, and a biasing member 124. The biasing member 124 biases the deformer 116 in a default position relative the nip plane 60 that causes the deformer 116 to deform a portion of the media sheet 86 transported by the roller pairs 38. The amount of media sheet deformation may be altered by repositioning the deformer 116 relative the nip plane 60. To this end, the positioning member 120 is configured to interface with an actuator 74 upon a peripheral device 22. Upon interfacing with an actuator 74, the positioning member 120 may be pivoted to a new position. Because the positioning member 120 is coupled to the deformer 116 via the support member 104, the movement of the positioning member 120 repositions the deformer 116 and alters the amount of media sheet deformation. Below each component of the media sheet deforming device 100 is explained in detail.

The support member 104 refers to any device movably coupled to the printer frame 36 upon which a deformer 116 and positioning member 120 may be coupled thereto. The support member 104 may be constructed of any rigid material including, but not limited to, injection molded thermoplastics, carbon fiber materials, sheet metal, or other types of metals and metallic alloys. An upper portion 106 of the support member 104 extends from the pivot shaft 108 to the deformer 116 and a lower portion 110 of the support member 104 extends from the pivot shaft 108 to the positioning member 120. The upper 106 and lower portions 110 form an angle with the pivot shaft 108 being the vertex. The magnitude of the angle may range from approximately 40° to 200°.

The pivot shaft 108 pivotally couples the support member 104 to the printer 10. In particular, as shown in FIGS. 2 and 3, the pivot shaft 108 is coupled to the printer 10 by brackets 82. The pivot shaft 108 may be made of the same material as the support member 104. When the support member 104 is formed of injection molded thermoplastic, the pivot shaft 108 may be integral with the support member 104. Alternatively, the pivot shaft 108 may be formed separately and be nonrotatably connected to the support member 104. The pivot shaft 108 has a longitudinal axis that is generally parallel to the nip plane 60. The length of the pivot shaft 108 depends, among other factors, on the separation of the brackets 82 and the particular type of biasing member 124. Likewise, the diameter of the pivot shaft 108 depends, among other factors, on the type of brackets 82 utilized, the type of biasing member 124, and the torque generated by the biasing member 124.

As used herein the term "deformer" 116 refers to the portion of the media sheet deforming device 100 that contacts and deforms media sheets 86. In particular, the deformer 116 may contact a media sheet 86 causing the media sheet 86 to exhibit an arched profile. The arched profile increases the beam strength of the media sheet 86. Specifically, the arched profile may be an arch that spans at least a portion of the width of the media sheet 86. Alternatively, the arched profile may be an arch that spans at least a portion of the length of the media sheet 86.

The deformer 116 is coupled to the upper portion 106 of the support member 104. In some embodiments the deformer 116 may be integral with the support member 104. As illustrated in FIGS. 1-6, the deformer 116 is provided as a wheel 118; however, the media sheet deforming device 100 may utilize any type of deformer 116 capable of temporarily deforming a media sheet 86 transported by the roller pairs 38. The deformer 116 is configured to be positioned in the media path 14 of the printer 10. Specifically, the deformer 116 is located in the gap 42 between the roller pairs 38. Depending on the position of the support member 104 and the positioning member 120, the deformer 116 may or may not intersect the nip plane 60. In most embodiments, the deformer 116 may not mark or permanently crease the media sheets 86 transported by the roller pairs 38.

The wheel 118 is rotatably secured to the wheel shaft 112 of the support member 104. The wheel 118 may be made of materials including, but not limited to, injection molded thermoplastics, carbon fiber materials, sheet metal, or other types of metals and metallic alloys. As illustrated best in FIG. 3, the wheel 118 has a convex circumferential periphery and opposed end portions. The circumferential periphery permits the wheel 118 to contact a media sheet 86 without permanently creasing or otherwise damaging the media sheet 86. The width of the wheel 118 depends, among other factors, on the length of the gap 42 and the curvature of the circumferential periphery.

The wheel shaft 112 extends horizontally from the support member 104, as illustrated most clearly in FIG. 3. The wheel shaft 112 may be made of the same material as the support member 104. When the support member 104 is formed of injection molded thermoplastic, the wheel shaft 112 may be integral with the support member 104. Alternatively, the wheel shaft 112 may be formed separately and nonrotatably connected to the support member 104. The wheel shaft 112 may have a longitudinal axis that is generally parallel to the nip plane 60. The length of the wheel shaft 112 depends, among other factors, on the width of the wheel 118 and the length of the gap 42. The wheel shaft 112 rotatably couples the wheel 118 to the support member 104 without preventing or impeding the ability of the support member 104 to pivot about the pivot shaft 108.

The torque generated by the biasing member 124 biases the support member 104 against a stop tab 128. The media sheet deforming device 100 may utilize any type of biasing member 124 that is capable of exerting a torque upon the support member 104. An exemplary biasing member 124 is provided in the form of a torsion spring having a central channel 132, a lower extension leg 136, and an upper extension leg 140. The channel 132 may have a diameter slightly larger than the diameter of the pivot shaft 108 so that the pivot shaft 108 may be inserted into the channel 132. The lower extension leg 136 contacts the printer frame 36, and the upper extension leg 140 contacts a tab 144 on the support member 104, as illustrated in FIG. 3.

The stop tab 128 of FIGS. 1-3 is any element configured to determine the rotational position of the support member 104 when the deformer 116 is not in contact with a media sheet 86 and the positioning member 120 has not interfaced with an actuator 74. The stop tab 128 is coupled to the printer frame 36, and is made from a rigid material. The stop tab 128 may remain rigid without bending or breaking under the force imparted upon it by the biasing member 124. Furthermore, the position of the stop tab 128 in combination with the length the upper portion 106 of the support member 104 and the size of the deformer 116, determines the position of the deformer 116 relative the nip plane 60 when the support member 104 is biased against the stop tab 128.

The positioning member 120 is the portion of the media sheet deforming device 100 that interfaces with an actuator 74 upon a peripheral device 22 to alter the amount of media sheet deformation. The positioning member 120 is configured to assert a force on the support member 104 and alter an amount of media sheet deformation. As illustrated in FIGS. 1-3, the positioning member 120 may be coupled to the lower portion 110 of the support member 104. The positioning member 120 may be made of the same material as the support member 104.

In particular, when the support member 104 is formed of injection molded thermoplastic, the positioning member 120 may be integral with the support member 104. On the other hand, the positioning member 120 may be made separately and coupled to the support member 104. The positioning member 120 interfaces with an actuator 74 upon a peripheral device 22. Specifically, when a peripheral device 22 having an actuator 74 is coupled to the printer 10, the actuator 74 asserts a force on the positioning member 120 that alters the amount of media sheet deformation. Accordingly, the actuator 74 may be configured to contact the positioning member 120. Alternatively, the positioning member 120 may be magnetically coupled to the actuator 74. Thus, while the positioning member 120 is configured to interface with the actuator 74, the positioning member 120 is not necessarily configured to contact the actuator 74.

The positioning member 120 of FIGS. 1-3 is provided as a contact surface 122. The contact surface 122 may have a surface area at least as large as the area of opening 78 in the printer 10. The contact surface 122 may be a flat planar surface, or the contact surface 122 may include a curvature or depression configured to interface with a particular size or shape of actuator 74. Additionally, the contact surface 122 may be offset from the support member 104 in order to align the contact surface 122 with the opening 78.

In operation, the media sheet deforming device 100 of FIGS. 1-3 increases the beam strength of a media sheet 86 with a variable amount of media sheet deformation. Specifically, when a peripheral device 22 is not coupled to the printer 10, or when a peripheral device 22 without an actuator 74 is coupled to the printer 10, the media sheet deforming device 100 applies a default amount of media sheet deformation to a media sheet 86 transported by the roller pairs 38. However, when a peripheral device 22 having an actuator 74 is coupled to the printer 10, the amount of media sheet deformation may be reduced or even eliminated. Below, operation of the media sheet deforming device 100 of FIGS. 1-3 is explained, first without a peripheral device 22 coupled to the printer 10 and second with a peripheral device 22 coupled to the printer 10.

When a peripheral device 22 is not coupled to the printer 10, biasing member 124 biases the support member 104 against the stop tab 128. In this position, at least a portion of the deformer 116 or wheel 118 intersects the nip plane 60, as most clearly illustrated in FIG. 3. Accordingly, when a media sheet 86 approaches the roller pairs 38, the leading edge of the media sheet 86 is grasped by the roller pairs 38 and is propelled into contact with the deformer 116. Because at least a portion of the deformer 116 is positioned above the nip plane 60, the portion of the media sheet 86 located in the gap 42 contacts the deformer 116 and is deformed away from the nip plane 60, giving the media sheet 86 an arched longitudinal profile that increases the beam strength of the media sheet 86, as best illustrated in FIG. 3. The amount by which the deformer 116 deforms the media sheet 86 may be altered depending upon, among other factors, the rigidity of the media sheet 86, the torque generated by the biasing member 124, and the distance by which the deformer 116 is positioned above the nip plane 60.

When a peripheral device 22 having an actuator 74 is coupled to the printer 10, the actuator 74 interfaces with the positioning member 120 causing the support member 104 to rotate about the pivot shaft 108. Rotation of the support member 104 reduces the amount of media sheet deformation, because as the support member 104 pivots in response to interfacing with an actuator 74, the portion of the deformer 116 positioned above the nip plane 60 is reduced. Accordingly, a media sheet 86 transported by the roller pairs 38 may still contact the deformer 116; however, because less of the deformer 116 is positioned above the nip plane 60 the media sheet 86 is deformed to a lesser extent. The amount by which the media sheet deformation is reduced depends, among other factors, on the length of the actuator 74, the geometry of the support member 104, and the natural beam strength of the media sheet 86. For instance, the amount of media sheet deformation may be completely eliminated if the length of the actuator 74 causes the entire deformer 116 to become positioned below the nip plane 60. Alternatively, the length of the actuator 74 may simply decrease the amount by which the deformer 116 extends above the nip plane 60 to reduce but not eliminate the amount of media sheet deformation.

The extent to which the position of the deformer 116 is altered in response to the positioning member 120 interfacing with an actuator 74 is also determined by the geometry of the support member 104. In particular, the relative lengths of the upper 106 and lower portions 110 of the support member 104 impacts the precision with which the amount of media sheet deformation may be altered. In particular, at least two embodiments may be implemented; namely, an "on/off" geometry and a variable deformation geometry.

The "on/off" geometry may be implemented in numerous ways, including with a support member 104 having a lower portion 110 which is comparatively longer than the upper portion 106. With such a support member 104, a small change in the position of the lower portion 110 results in a comparatively larger change in position of the upper portion 106, due to the mechanical advantage of the support member 104. Accordingly, the position of the deformer 116 relative the nip plane 60 is greatly affected by small variations in the length of the actuator 74, as may be suited for a media sheet deforming device 100 that is either "on" or "off" depending on the absence or presence of an actuator 74 upon a peripheral device 22.

The variable deformation geometry may also be implemented in various ways, including with a support member 104 having a lower portion 110 that is comparatively shorter than the upper portion 106. With such a support member 104, small changes in the position of the lower portion 110 results in comparatively smaller changes in the position of the upper portion 106. Accordingly, the position of the deformer 116 relative the nip plane 60 may be only marginally affected by small variations of actuator 74 length, as may be suited for a media sheet deforming device 100 that provides a highly variable amount of deformation to a media sheet 86.

The amount of media sheet deformation provided by the media sheet deforming device 100 is also dependent on the natural beam strength of a media sheet 86. Specifically, the media sheet deforming device 100 is capable of automatically self-adjusting to apply a variable amount of media sheet deformation to each media sheet 86 transported by the roller pairs 38. For example, if a media sheet 86 has a low degree of natural beam strength, when the media sheet 86 contacts the deformer 116, the portion of the media sheet 86 located in the gap 42 may become deformed above the nip plane 60 by a distance equal to the distance the deformer 116 extends above the nip plane 60. If, however, the media sheet 86 has a comparatively high natural beam strength, as the media sheet 86 contacts the deformer 116 the media sheet 86 may force the deformer 116 to pivot away from the nip plane 60, causing less of the deformer 116 to be positioned above the nip plane 60, and also causing the media sheet 86 to be deformed to a lesser degree. This self-adjusting feature ensures the media sheet deforming device 100 deforms each media sheet 86 transported by the roller pairs 38 to a proper degree.

Figure 4:
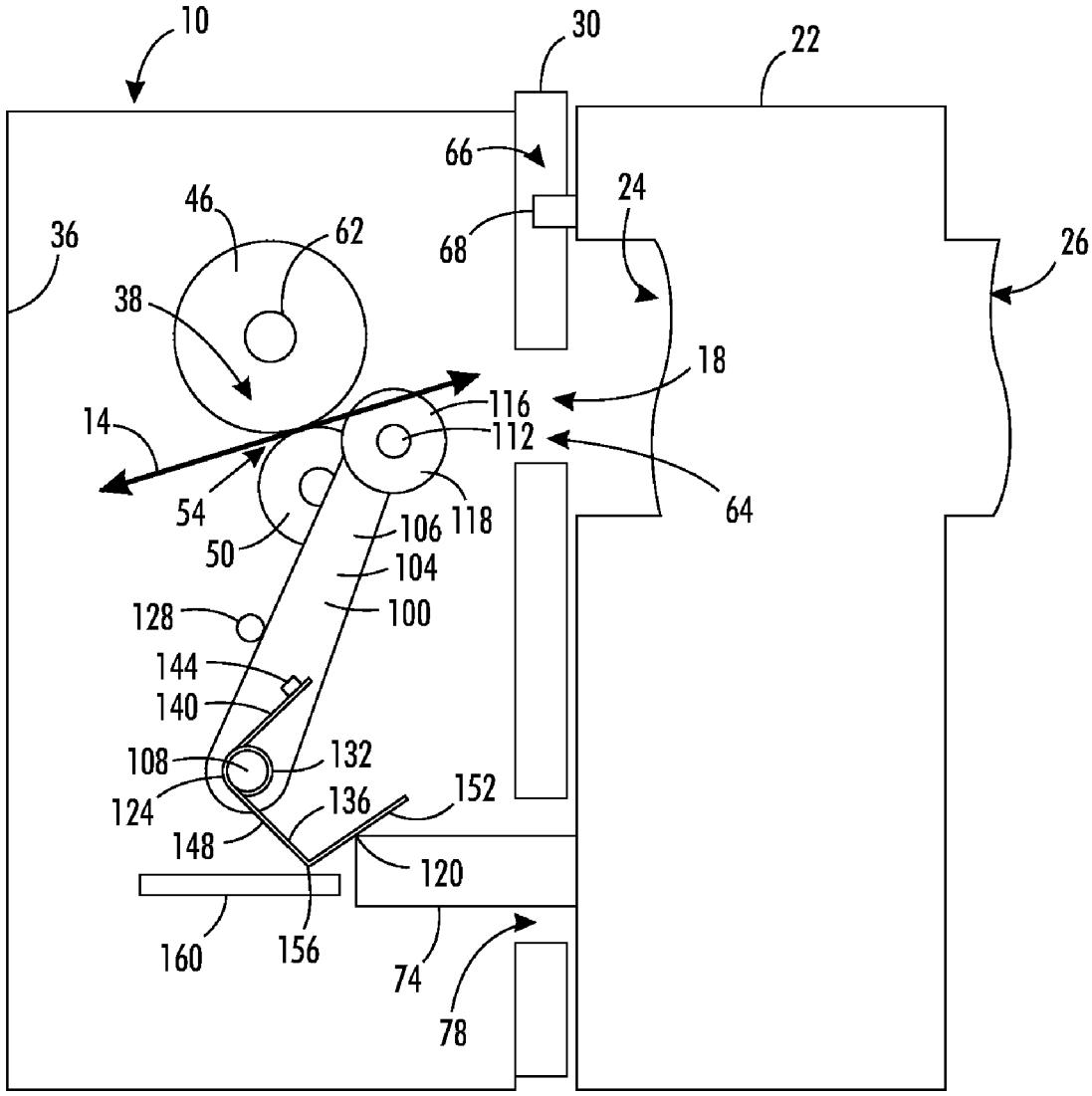
FIG. 4 illustrates an elevational view of an alternative embodiment of the media sheet deforming device coupled to the printer of FIG. 1.
Figure 5:
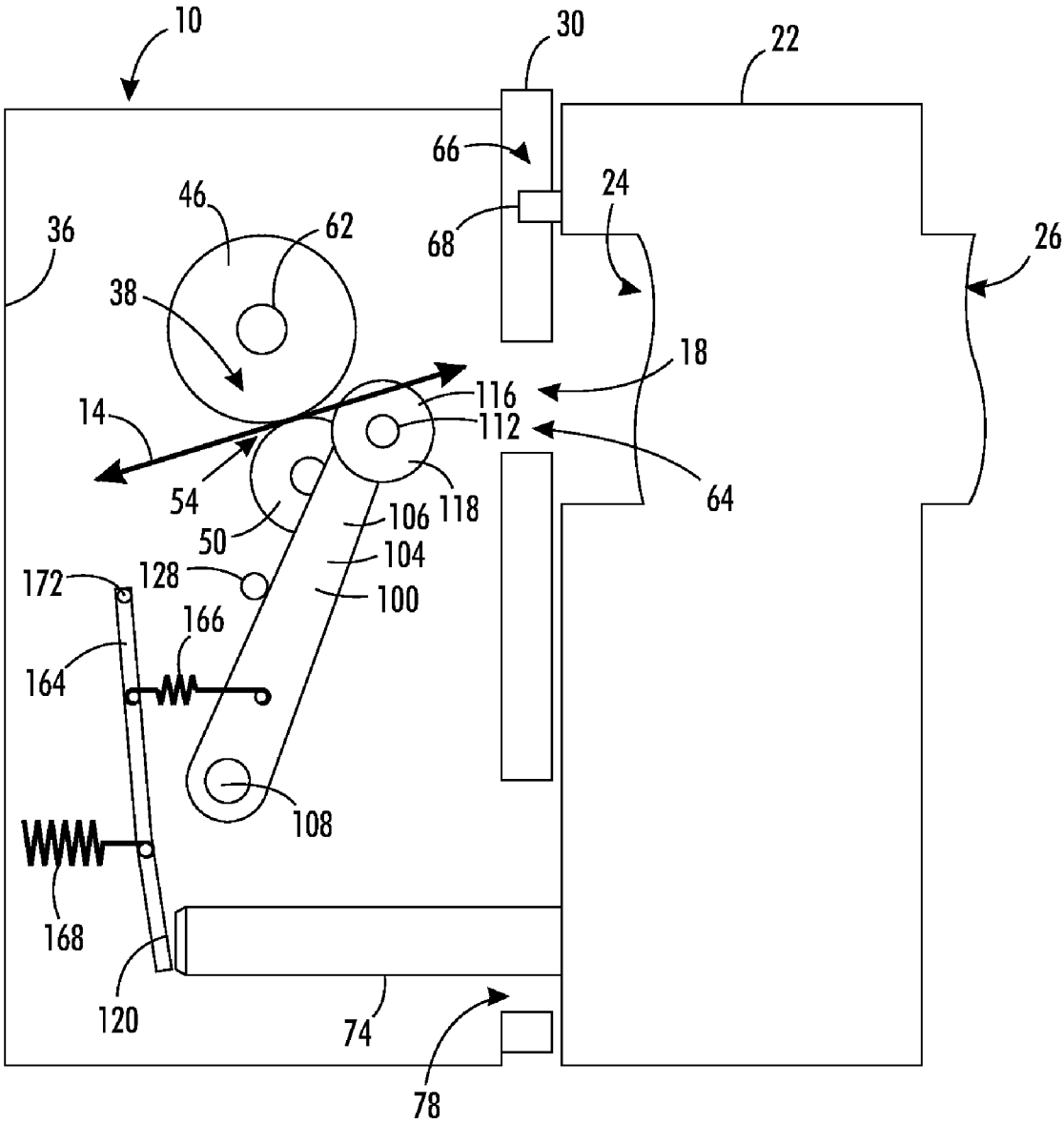
FIG. 5 illustrates an elevational view of an alternative embodiment of the media sheet deforming device coupled to the printer of FIG. 1.
Figure 6:
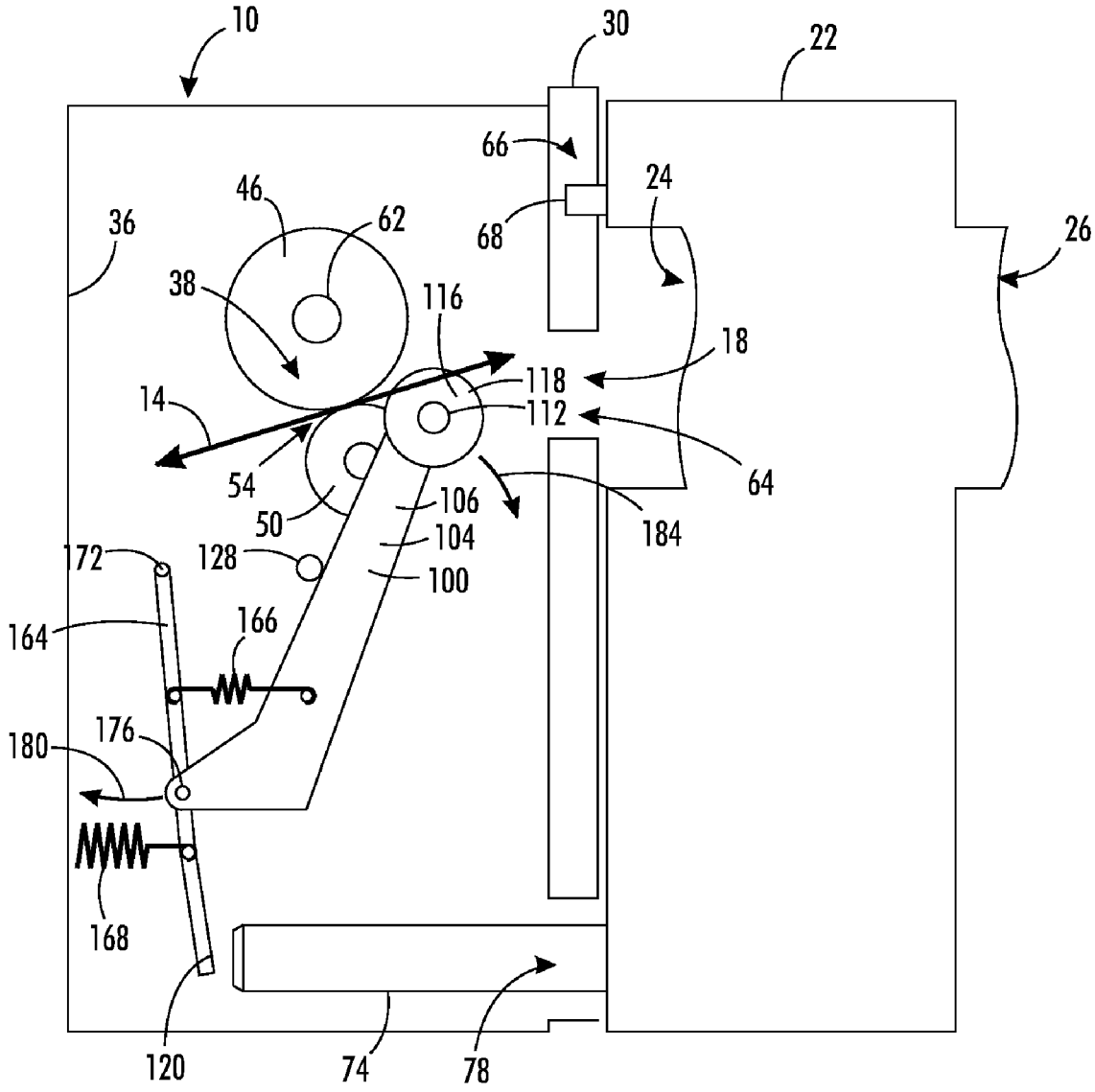
FIG. 6 illustrates an elevational view of an alternative embodiment of the media sheet deforming device coupled to the printer of FIG. 1.

FIGS. 4-6 illustrate alternative embodiments of the media sheet deforming device 100. As illustrated in FIG. 4, the media sheet deforming device 100 may be modified to be biased against the stop tab 128 with an increased force in response to the positioning member 120 interfacing with an actuator 74. The media sheet deforming device 100 of FIG. 4 includes a support member 104 that extends only from the pivot shaft 108 to the deformer 116. Additionally, the positioning member 120 of FIG. 4 is provided as the lower extension leg 136 of the biasing member 124. In this embodiment, the lower extension leg 136 includes a first portion 148 that extends tangentially from the pivot shaft 108 and a second portion 152 angled approximately ninety degrees from the first portion 148 to form an elbow 156. The torque generated by the biasing member 124 causes the elbow 156 to abut a stop rod 160 coupled to the printer frame 36 and also causes the support member 104 to be biased against the stop tab 128.

When a peripheral device 22 is not coupled to the printer 10 the media sheet deforming device 100 of FIG. 4 operates similarly to the media sheet deforming device 100 of FIGS. 1-3. However, when a peripheral device 22 having an actuator 74 is attached to the printer 10, the length of the actuator 74 alters the amount of media sheet deformation by increasing the force that biases the support member 104 against the stop tab 128. Specifically, when an actuator 74 interfaces with the positioning member 120, the actuator 74 lifts the elbow 156 off the stop rod 160. As the elbow 156 is lifted off the stop rod 160, the biasing member 124 generates an increased torque that causes the support member 104 to become biased against the stop tab 128 with a greater force. Accordingly, the length of the actuator 74 does not alter the amount of media sheet deformation by changing the position of the deformer 116 relative the nip plane 60. Instead, the amount of media sheet deformation is altered by changing the manner in which the media sheet deforming device 100 self-adjusts to the natural beam strength of a media sheet 86. In particular, the media sheet deforming device 100 self-adjusts to a lesser extent when the support member 104 is biased against the stop tab 128 with an increased force.

The media sheet deforming device 100 of FIG. 5 is also configured to be biased against the stop tab 128 with an increased force in response to the positioning member 120 interfacing with an actuator 74. The media sheet deforming device 100 includes a pivot member 164, a first biasing member 166, and a second biasing member 168. The term "pivot member" 164, as used herein, refers to any device that may be coupled to the printer frame 36 and that includes a portion that may function as a positing member 120 or upon which a positioning member 120 may be coupled. The biasing members 166, 168 are configured to bias the support member 104 against the stop tab 128 with a first force. In particular, the first biasing member 166 may be an extension spring configured to apply a tension force upon the support member 104 and the pivot member 164 that biases the support member 104 against the stop tab 128. The tension force of the first biasing member 166 also biases the pivot member 164 toward the opening 78. The second biasing member 168 may be a compression spring configured to stabilize the position of the pivot member 164. Additionally, the bottom end of the pivot member 164 functions as the positioning member 120.

When a peripheral device 22 is not coupled to the printer 10 the media sheet deforming device 100 of FIG. 5 operates similarly to the media sheet deforming device 100 of FIGS. 1-3. However, when a peripheral device 22 having actuator 74 is coupled to the printer 10, the actuator 74 interfaces with the bottom end of the pivot member 164 causing the pivot member 164 to rotate about pivot point 172. Rotation of the pivot member 164 stretches biasing member 166 causing the support member 104 to be biased against the stop tab 128 with a greater force. The force with which biasing member 166 biases the support member 104 against the stop tab 128 is directly proportional to the length of the actuator 74. Accordingly, an actuator 74 having a greater length stretches biasing member 166 to a greater degree, resulting in a greater force biasing the support member 104 against the stop tab 128. Similar to the embodiment of FIG. 4, the media sheet deforming device 100 of FIG. 5 does not alter the amount of media sheet deformation by repositioning the deformer 116 relative the nip plane 60. Instead, the amount of media sheet deformation is altered by changing the manner in which the media sheet deforming device 100 self-adjusts to the natural beam strength of a media sheet 86.

In another embodiment, illustrated in FIG. 6, the media sheet deforming device 100 has been modified to alter an amount of media sheet deformation by changing both the biasing force upon the support member 104 and the position of the deformer 116 relative the nip plane 60. The media sheet deforming device 100 includes the pivot member 164, first biasing member 166, and second biasing member 168 each described with reference to the media sheet deforming device 100 of FIG. 5. However, the support member 104 of FIG. 6 is pivotally connected to the pivot member 164 at pivot point 176, instead of being pivotally coupled to the printer frame 36. Thus, the support member 104 is repositioned as the pivot member 164 pivots about pivot point 172.

When a peripheral device 22 is not coupled to the printer 10 the media sheet deforming device 100 of FIG. 6 operates similarly to the media sheet deforming device 100 of FIGS. 1-3. However, when a peripheral device 22 having an actuator 74 is attached to the printer 10, the actuator 74 interfaces with the lower end of the pivot member 164 causing the pivot member 164 to rotate about pivot point 172. Rotation of the pivot member 164 causes biasing member 166 to bias the support member 104 against the stop tab 128 with a greater force. Additionally, rotation of the pivot member 164 causes pivot point 176 and the lower end of the support member 104 to move along a radial path, as identified by direction 180 of FIG. 6. Motion of the support member 104 along radial path 180, causes the deformer 116 to move away from the nip plane 60. In particular, as the pivot member 164 is pivoted in response to the length of an actuator 74, the deformer 116 follows a curved path away from the nip plane 60, as identified by direction 184 of FIG. 6. Thus, the media sheet deforming device 100 of FIG. 6 alters an amount of media sheet deformation in at least two ways. First, the amount of media sheet deformation is altered by biasing the support member 104 against the stop tab 128 with a force dependent on the length of the actuator 74. Second, the amount of media sheet deformation is altered by shifting the position of the deformer 116 relative the nip plane 60. An actuator 74 having a great enough length may eliminate the amount of media sheet deformation by positioning the deformer 116 below the nip plane 60.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A printer having a device for nonpermanently deforming a media sheet in the printer to increase beam strength of the media sheet temporarily, the device comprising:

a deformer positioned in a media path within the printer, the deformer being configured to deform the media sheet temporarily with an amount of media sheet deformation when the deformer is at a first position, the amount of media sheet deformation causing the media sheet to exhibit an arched profile that increases beam strength of the media sheet, and to enable the media sheet to pass without deformation when the deformer is at a second position;

a support member coupled to the deformer, the support member being movably coupled to a printer frame; and a positioning member coupled to the support member, the positioning member being configured to move from a first position to a second position in response to an actuator upon a peripheral device mounted to the printer holding the positioning member at the second position to hold the deformer at a position between the first position and the second position for the deformer to change the amount of media sheet deformation in the media sheet deformed by the deformer while the positioning member is held at the second position by the actuator upon the peripheral device.

2. The printer of claim 1, the deformer being a wheel rotatably coupled to the support member, the wheel having a convex circumferential periphery.

3. The printer of claim 1 further comprising:

a stop tab connected to the printer frame; and a biasing member coupled to the support member, the biasing member configured to bias the support member to a first position in which the support member contacts the stop tab with a first biasing force.

4. The printer of claim 3, the positioning member being further configured to respond to the actuator holding the positioning member at the second position by moving the biasing member to a position that increases the first biasing force to a second biasing force that is greater in magnitude than the first biasing force.

5. The printer of claim 4, the positioning member further configured to be an extension leg coupled to the biasing member.

6. The printer of claim 4, further comprising:

a pivot member coupled to the support member, a first end of the pivot member being movably coupled to the printer frame, the positioning member being located at a second end of the pivot member, and the biasing member being connected to the pivot member and the support member.

7. The printer of claim 6, the support member further configured to be pivotally connected to the pivot member.

8. The printer of claim 1 wherein the positioning member is configured to be magnetically coupled to the actuator.

9. A method of nonpermanently deforming a media sheet in a printer to increase beam strength of the media sheet temporarily, the method comprising:

positioning a deformer in a media path within the printer, the deformer being configured to deform the media sheet temporarily with an amount of media sheet deformation when the deformer is at a first position, the amount of media sheet deformation causing the media sheet to exhibit an arched profile that increases beam strength of the media sheet; and moving and holding the deformer at a second position in response to an actuator of a peripheral device interacting with a positioning member that is coupled to the deformer, the deformer at the second position deforming the media sheet with an amount of media sheet deformation that is greater than no media sheet deformation but less than the amount of media sheet deformation occurring when the deformer is at the first position.

10. The method of claim 9 further comprising:

biasing a support member coupled between the deformer and the positioning member against a stop tab with a biasing member, the biasing member being configured to resist movement of the support member occurring in response to the positioning member moving in response to the actuator of the peripheral device interacting with the positioning member.

11. The method of claim 9 further comprising:

biasing a support member coupled between the deformer and the positioning member against a stop tab with a biasing member, the biasing member biasing the support member against the stop tab with a biasing force to move the deformer to the second position about a curved path.

12. The method of claim 9, the interaction of the actuator and the positioning member further comprising:

magnetically coupling the positioning member and actuator.

13. A printer for generating an image on a media sheet comprising:

a first and second roller pair coupled to a printer frame, the first and second roller pairs separated by a gap and configured to transport media sheets along a media sheet transport plane; and a device for nonpermanently deforming the media sheet, the device comprising:

a deformer configured to move to a first position in the gap and a second position outside of the gap, the deformer at the first position intersects the media sheet transport plane and deforms the media sheet temporarily with an amount of media sheet deformation, the amount of media sheet deformation causing the media sheet to exhibit an arched profile that increases beam strength of the media sheet, the deformer at the second position does not intersect the media sheet transport plane to inhibit media sheet deformation; and a positioning member coupled to the deformer and configured to move and hold the deformer at a third position within the gap to deform the media in the media transport plane by an amount of media sheet deformation that is less than the amount of media sheet deformation occurring when the deformer is at the first position but greater than the amount of media sheet deformation at the second position in response to the positioning member being moved from a first position to a second position.

14. The printer of claim 13, further comprising:

a stop tab connected to the printer frame;

a support member coupled to the deformer and to the positioning member; and a biasing member coupled to the support member, the biasing member configured to bias the support member into contact with the stop tab with a first biasing force, and the positioning member being further configured to move the biasing member to bias the support member with a second biasing force that is greater in magnitude than the first biasing force.

15. The printer of claim 14, further comprising:

a pivot member coupled to the support member, a first end of the pivot member being movably coupled to the printer frame, the positioning member being located at a second end of the pivot member, and the biasing member being connected to the pivot member and the support member.

16. The printer of claim 13, further comprising:

a stop tab connected to the printer frame;

a support member coupled to the deformer and to the positioning member;

a biasing member coupled to the support member, the biasing member configured to bias the support member into contact with the stop tab with a first biasing force; and a pivot member coupled to the support member, a first end of the pivot member being movably coupled to the printer frame and the positioning member being located at a second end of the pivot member, the biasing member being connected to the pivot member and the support member, and the positioning member being configured to move the deformer to the third position about a curved path defined by the stop tab.

17. The printer of claim 13 wherein the positioning member is configured to be magnetically coupled to the actuator.

* * * * *